US006393646B1

(12) United States Patent
Beers, Jr. et al.

(10) Patent No.: US 6,393,646 B1
(45) Date of Patent: May 28, 2002

(54) GOLF GREEN BRUSH

(76) Inventors: Wilson Beers, Jr., 3168 Corydon, Cleveland Heights, OH (US) 44118; Wilson Beers, Sr., 29308 Fairway Blvd., Willowick, OH (US) 44095; William F. Anderson, 20819 Lake Rd., Rocky River, OH (US) 44116

( * ) Notice: Subject to any disclaimer, the term of this patent is extended or adjusted under 35 U.S.C. 154(b) by 0 days.

(21) Appl. No.: 09/390,432

(22) Filed: Sep. 7, 1999

(51) Int. Cl.[7] ..... A46B 15/00
(52) U.S. Cl. ..... 15/144.4; 15/184; 15/160
(58) Field of Search ..... 15/144.4, 144.3, 15/184, 165, 146, 160, 169; 132/311, 313, 317, 318, 320

(56) References Cited

U.S. PATENT DOCUMENTS

| | | | | | |
|---|---|---|---|---|---|
| 1,138,244 | A | * | 5/1915 | Parker | 15/184 |
| 1,140,690 | A | * | 5/1915 | Lipari | 15/184 |
| 1,166,269 | A | * | 12/1915 | Smith | 15/184 |
| 1,192,298 | A | * | 7/1916 | Gerstenzang | 15/184 |
| 1,300,884 | A | * | 4/1919 | Schwertz | 15/184 |
| 2,545,091 | A | * | 3/1951 | Livermore | 15/184 |
| 2,739,331 | A | * | 3/1956 | Goodman | 15/184 |
| 2,896,241 | A | * | 7/1959 | Cofman | 15/184 |
| 3,309,728 | A | * | 3/1967 | Seaver | 15/184 |
| 3,999,243 | A | | 12/1976 | La Pour | 15/344 |
| 5,319,821 | A | | 6/1994 | Nicholson et al. | 15/104.8 |
| 5,511,785 | A | | 4/1996 | Rusin, Jr. | 473/286 |
| 5,625,918 | A | | 5/1997 | Kieson et al. | 15/119.2 |
| 5,661,868 | A | | 9/1997 | Panagakos et al. | 15/184 |

* cited by examiner

*Primary Examiner*—Gary K. Graham
(74) *Attorney, Agent, or Firm*—Tarolli, Sundheim, Covell, Tummino & Szabo L.L.P.

(57) ABSTRACT

A golf green brush assembly (10) comprises a tubular first handle portion (20) having an inner end portion (30, 46) adapted to be manually gripped by the hand of a person and having an opposite outer end portion (34). The first handle portion (20) has an elongate central passage (28) terminating in a terminal opening (36) in the outer end portion (34) of the first handle portion. The brush assembly (10) also includes a second handle portion (50, 70) having opposite inner and outer end portions (58, 80). The second handle portion (48) extends through the terminal opening (36) in the outer end portion (34) of the first handle to portion (20). The inner end portion (58) of the second handle portion is telescopically received in the central passage (28) in the first handle portion (20). The brush assembly (10) further includes a brush (90) for sweeping engagement with the golf green. The brush (90) is disposed on the outer end portion (80) of the second handle portion. The second handle portion (50, 70) is telescopically retractable into the first handle portion (20) whereby the brush (90) is received at least substantially completely within the first handle portion.

8 Claims, 2 Drawing Sheets

GOLF GREEN BRUSH

BACKGROUND OF THE INVENTION

The present invention relates to a golf green brush for assisting a golfer in the clearing of his path on a golf green. In particular, the present invention relates to a golf green brush that is easily collapsible so that it can fit into a pocket of a golfer.

SUMMARY OF THE INVENTION

The present invention is a golf green brush assembly for assisting a golfer in the clearing of a path on a golf green. The brush assembly comprises a tubular first handle portion having an inner end portion adapted to be manually gripped by the hand of a person and having an opposite outer end portion. The first handle portion has an elongate central passage terminating in a terminal opening in the outer end portion of the first handle portion. The brush assembly also includes a second handle portion having opposite inner and outer end portions. The second handle portion extends through the terminal opening in the outer end portion of the first handle portion. The inner end portion of the second handle portion is telescopically received in the central passage in the first handle portion. The brush assembly further includes a brush for sweeping engagement with the golf green. The brush is disposed on the second handle portion. The second handle portion is telescopically retractable into the first handle portion whereby the brush is received at least substantially completely within the first handle portion.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
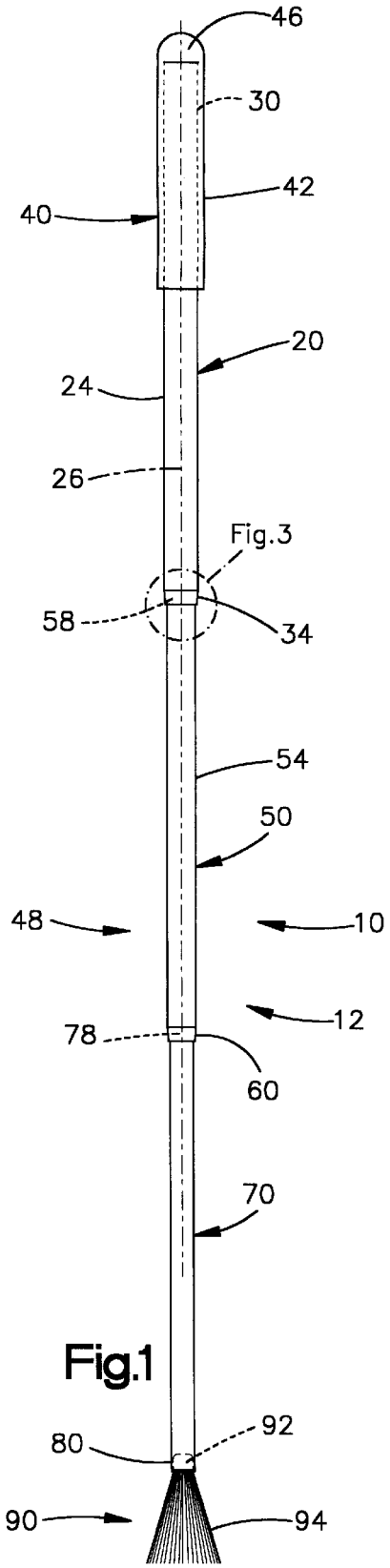
FIG. 1 is an elevational view of a brush assembly in accordance with the present invention, shown in an extended condition.

The present invention relates to a golf green brush. The present invention is applicable to various golf green brush constructions. As representative of the present invention, FIG. 1 illustrates a golf green brush or brush assembly 10. The brush assembly 10 includes a handle assembly 12 and a brush 90.

The handle assembly 12 includes a first handle portion or outer tube 20. The outer tube 20 (FIGS. 1 and 2) has a tubular, cylindrical configuration including parallel, cylindrical inner and outer side surfaces 22 and 24 centered on a longitudinal central axis 26 of the brush assembly 10.

The cylindrical inner surface 22 of the outer tube 20 defines a central passage 28 (FIG. 3) in the outer tube. The central passage 28 extends for the entire length of the outer tube 20. The outer tube 20 has a first or inner end portion 30 (FIG. 2) that terminates in an opening 32.

The outer tube 20 has a second or outer end portion 34 (FIG. 3) opposite the inner end portion 30. The outer end portion 34 is tapered radially inward in a direction toward the central axis 26. The central passage 28 of the outer tube 20 terminates in a terminal opening 36 (FIG. 4) in the outer end portion 34 of the outer tube 20.

A grip 40 (FIGS. 1 and 2) is mounted on the outer tube 20. The grip 40 is made from a plastic or rubber material. The grip 40 has a tubular main body portion 42 having a cylindrical inner side surface 44. The inner side surface 44 of the grip 40 is received on the outer side surface 24 of the inner end portion 30 of the outer tube 20. The grip 40 has a domed end portion 46 formed as one piece with the main body portion 42 of the grip. The end portion 46 of the grip 40 extends across and doses the opening 32 in the inner end portion 30 of the outer tube 20.

The handle assembly 12 also includes a second handle portion 48 (FIG. 1) that is retractable into the first handle portion 20. The second handle portion 48 may have varying constructions. For example, the second handle portion 48 may include either one tube or a plurality of tubes. In the illustrated embodiment, the second handle portion 48 includes two tubes, specifically, an intermediate tube 50 and an inner tube 70. The intermediate tube 50 and the inner tube 70, as well as the outer tube 20, are made from brass, aluminum, plastic, or another suitable material.

The intermediate tube 50 (FIG. 3) has a tubular, cylindrical configuration including parallel, cylindrical inner and outer side surfaces 52 and 54 centered on the axis 26. The cylindrical inner surface 52 of the intermediate tube 50 defines a central passage 56 in the intermediate tube. The central passage 56 extends for the entire length of the intermediate tube 50.

The intermediate tube 50 has an inner end portion 58 (FIG. 3) that terminates in an opening 60. The inner end portion 58 is flared radially outward in a direction away from the central axis 26. The inner end portion 58 of the intermediate tube 50 is thus larger in diameter than the terminal opening 36 in the outer end portion 34 of the outer tube 20.

The inner end portion 58 of the intermediate tube 50 is telescopically received inside the outer tube 20. When the handle assembly 10 is extended as viewed in FIG. 3, the outwardly flared inner end portion 58 of the intermediate tube 50 engages the inwardly tapered outer end portion 34 of the outer tube 20. This engagement blocks removal of the intermediate tube 50 from the outer tube 20.

The intermediate tube 50 has an outer end portion 60 (FIG. 4) opposite the inner end portion 58. The outer end portion 60 is tapered radially inward in a direction toward the central axis 26. The central passage 56 of the (intermediate tube 20 terminates in a terminal opening 62 in the outer end portion 60 of the intermediate tube 50.

The inner tube 70 has a tubular, cylindrical configuration including parallel, cylindrical inner and outer side surfaces 72 and 74 (FIG. 4) centered on the axis 26. The cylindrical inner surface 72 of the inner tube 70 defines a central passage 76 in the inner tube. The central passage 76 extends for the entire length of the inner tube 70.

The inner tube 70 has an inner end portion 78 (FIG. 2) that terminates in an opening. The inner end portion 78 is flared radially outward in a direction away from the central axis 26. The inner end portion 78 of the inner tube 70 is thus larger in diameter than the terminal opening 62 in the outer end portion 60 of the intermediate tube 50.

The inner end portion 78 of the inner tube 70 is telescopically received inside the intermediate tube 50. When the handle assembly 10 is extended as viewed in FIG. 3, the outwardly flared inner end portion 78 of the inner tube 70 engages the inwardly tapered outer end portion 60 of the intermediate tube 50. This engagement blocks removal of the inner tube 70 from the intermediate tube 50.

The inner tube 70 has a cylindrical outer end portion 80 opposite the inner end portion 78. The brush 90 is mounted on the outer end portion 80 of the inner tube 70. The brush 90 includes a cap 92 (FIG. 4) and a plurality of tufts 94. A domed main body portion 96 of the cap 92 is fixed inside the outer end portion 80 of the inner tube. A radial mounting flange 98 of the cap 92 is slightly larger in diameter than the inner diameter of the outer end portion 60 of the intermediate tube 50.

Inner end portions 100 of the tufts 94 are fixed in the cap 92. Outer end portions 102 of the tufts 94 extend away from the cap 92 and, thus, away from the outer end portion 80 of the inner tube 70. The tufts 94 are preferably made of a water-resistant material so as not to hold water and transfer water into the golfer's pocket.

The brush assembly 10 is held closed by the outwardly biased pressure of the tufts against the inwardly tapered outer end portion 34 of the outer tube 20. To open the brush assembly for use, it is "flicked" to apply outwardly directed force in a direction along the axis 26. The force causes the tubes 20, 50 and 70 to be released from each other, extend, and lock in place.

When the brush assembly 10 is fully extended (FIG. 1), the outwardly flared inner end portion 58 of the intermediate tube 50 engages the inwardly tapered outer end portion 34 of the outer tube 20 to lock the intermediate tube in position relative to the outer tube. The outwardly flared inner end portion 78 of the inner tube 70 engages the inwardly tapered outer end portion 60 of the intermediate tube 70 to lock the inner tube in position relative to the intermediate tube. The handle assembly 12 is thus locked in its extended condition as shown in FIG. 1.

When the brush assembly 10 is extended, the tufts 94 are exposed at the end of the brush assembly. The tufts 94 are usable to sweep leaves or other obstacles from a golf green. The tufts 94 automatically flare radially outward when released from the confines of the outer tube 20, as seen in FIG. 1.

To store the brush assembly 10, the brush assembly is inverted so that the brush 90 is at the top. A small vertically directed force is then sufficient to collapse the handle assembly 12. As a result, the handle assembly 12 is manually retracted to the condition shown in FIG. 2.

When the handle assembly 12 is fully retracted, the intermediate tube 50 is retracted fully inside the outer tube 20. The inner end portion 58 of the intermediate tube 50 is disposed radially inward of the inner end portion 30 of the outer tube 20. The outer end portion 60 of the intermediate tube 50 is disposed radially inward of the outer tube 20, at a location spaced axially from the outer end portion 34 of the outer tube 20, as can be seen in FIGS. 2 and 4.

The inner tube 70 is at a position retracted fully inside the intermediate tube 50. The inner end portion 78 of the inner tube 70 is disposed radially inward of the inner end portion 58 of the intermediate tube 50. The outer end portion 80 of the inner tube 70 is disposed radially inward of the outer end to portion 60 of the intermediate tube 50, at a location spaced axially from the outer end portion 34 of the outer tube 20, as can be seen in FIGS. 2 and 4. The inner tube 70 can deflect the outer end portion 60 of the intermediate tube 50 sufficiently that the cap 92 retracts inside the intermediate tube.

Figure 2:
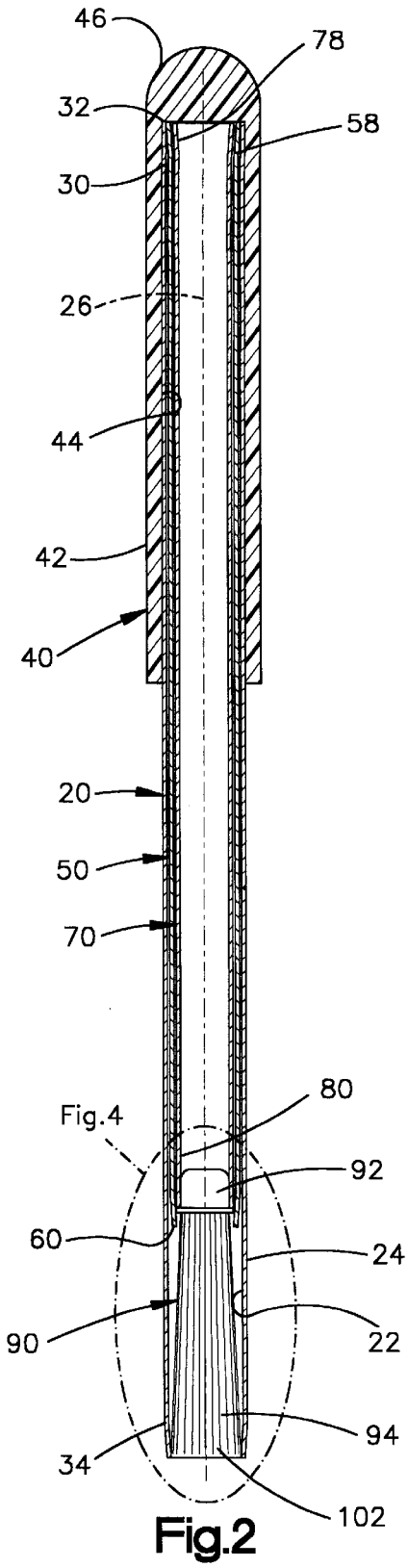
FIG. 2 is a sectional view of the brush assembly of FIG. 1, shown in a retracted or collapsed condition.
Figure 3:
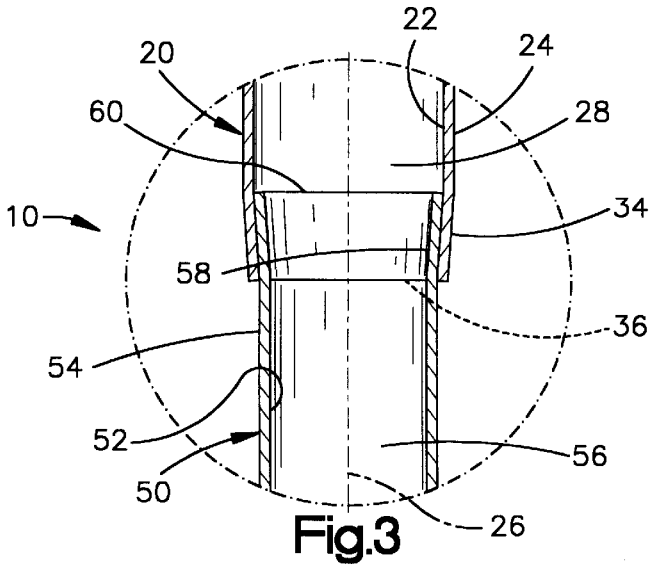
FIG. 3 is an enlarged sectional view taken at the location marked in FIG. 1.
Figure 4:
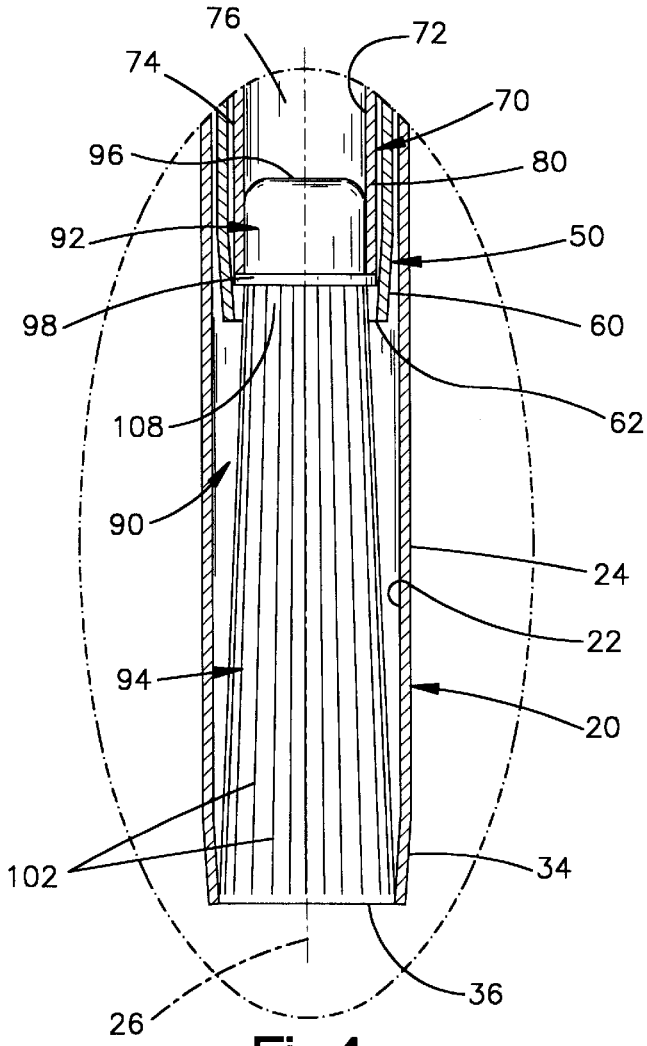
FIG. 4 is an enlarged sectional view taken at the location marked in FIG. 2.

The length of the outer tube 20 is selected so that the outer end portion 34 of the outer tube 20 projects past the inner and intermediate tubes 50 and 70, respectively, when the brush assembly 10 is fully retracted, as can be seen in FIGS. 2 and 4. The length of the tufts 94 is selected so that the tufts are enclosed within the outer end portion 34 of the outer tube 20 when the brush assembly 10 is fully retracted, as can be seen in FIGS. 2 and 4. As a result, the tufts 94 are protected. In addition, any dirt, moisture or other matter on the tufts 94 is kept from contact with the golfer or the golfer's clothing, because the tufts are fully retracted within the outer tube 20.

The brush assembly 10 is preferably sized to fit easily into a golfer's pocket. The brush assembly 10 when retracted has, for substantially its entire length, a smooth outer surface, which is the outer side surface 24 of the outer tube 20. This is because both the intermediate tube 50 and the inner tube 70 are fully retracted inside the outer tube.

From the above description of the invention, those skilled in the art will perceive improvements, changes and modifications in the invention. Such improvements, changes and modifications within the skill of the art are intended to be covered by the appended claims.

Having described the invention, we claim:

1. A golf green brush assembly for assisting a golfer in the clearing of a path on a golf green, said brush assembly having a retracted condition and an extended condition, said brush assembly comprising:

a tubular outer handle portion having a cylindrical main body portion, an inner end portion adapted to be manually gripped by the hand of a person and an opposite outer end portion, said outer handle portion having an elongate central passage centered on a longitudinal central axis of said assembly, said central passage terminating in a terminal opening in said outer end portion of said outer handle portion, said outer end portion of said outer handle portion being tapered radially inward in a direction toward said central axis from said cylindrical main body portion, a tubular intermediate handle portion having a cylindrical main body portion and opposite inner and outer end portions, said intermediate handle portion having an elongate central passage centered on said longitudinal central axis wherein said passage terminates in a terminal opening in said outer end portion of said intermediate handle portion, said intermediate handle portion extending through said terminal opening in said outer end portion of said outer handle portion, said inner end portion of said intermediate handle portion being telescopically received in said central passage in said outer handle portion, said outer end portion of said intermediate handle portion being tapered radially inward in a direction toward said central axis from said cylindrical main body portion, said inner end portion of said intermediate handle portion being tapered radially outward in a direction toward said central axis from said cylindrical main body portion;

a tubular inner handle portion having a cylindrical main body portion and opposite inner and outer end portions, said inner handle portion extending through said terminal opening in said outer end portion of said intermediate handle portion, said inner end portion of said inner handle portion being telescopically received in said central passage in said intermediate handle portion, said inner end portion of said outer handle portion being tapered radially outward in a direction toward said central axis from said cylindrical main body portion, and a brush for sweeping engagement with the golf green, said brush being secured on said outer end portion of said inner handle portion;

said outwardly tapered inner end portion of said inner handle portion interlocking with said inwardly tapered outer end portion of said intermediate handle portion when said brush assembly is in the extended condition, and said outwardly tapered inner end portion of said intermediate handle portion interlocking with said inwardly tapered outer end portion of said outer handle portion when said brush assembly is in the extended condition, to lock said brush assembly in the extended condition.

2. A brush assembly as set forth in claim 1 wherein:

said inner handle portion is fully enclosed within said intermediate handle portion, and said intermediate handle portion is fully enclosed within said outer handle portion, when said brush assembly is in the retracted condition; and said outer end portion of said intermediate handle portion is radially outward of said outer end portion of said inner handle portion when said brush assembly is in the retracted condition.

3. A brush assembly as set forth in claim 2 wherein:

said outer end portion of said intermediate handle portion, and said outer end portion of said inner handle portion, are spaced axially inward from said outer end portion of said outer handle portion by a distance approximately equal to the length of said brush when said brush assembly is in the retracted condition; and said brush is fully enclosed within said outer end portion of said outer handle portion but is not enclosed by said intermediate handle portion when said brush assembly is in the retracted condition.

4. A brush assembly as set forth in claim 1 wherein:

said outer end portion of said intermediate handle portion, and said outer end portion of said inner handle portion, are spaced axially inward from said outer end portion of said outer handle portion by a distance approximately equal to the length of said brush when said brush assembly is in the retracted condition; and said brush is fully enclosed within said outer end portion of said outer handle portion but is not enclosed by said intermediate handle portion when said brush assembly is in the retracted condition.

5. A brush assembly as set forth in claim 1 wherein said brush of said brush assembly has a plurality of outwardly biased tufts, and said brush assembly is held closed when in the retracted condition by the outwardly biased pressure of said tufts against said inwardly tapered outer end portion of said outer handle portion.

6. A golf green brush assembly for assisting a golfer in the clearing of a path on a golf green, said brush assembly having a retracted condition and an extended condition, said brush assembly comprising:

a tubular outer handle portion having a cylindrical main body portion, an inner end portion adapted to be manually gripped by the hand of a person and an opposite outer end portion, said outer handle portion having an elongate central passage centered on a longitudinal central axis of said assembly, said central passage terminating in a terminal opening in said outer end portion of said outer handle portion;

a tubular intermediate handle portion having a cylindrical main body portion and opposite inner and outer end portions, said intermediate handle portion having an elongate central passage centered on said longitudinal central axis wherein said passage terminates in a terminal opening in said outer end portion of said intermediate handle portion, said intermediate handle portion extending through said terminal opening in said outer end portion of said outer handle portion, said inner end portion of said intermediate handle portion being telescopically received in said central passage in said outer handle portion;

a tubular inner handle portion having a cylindrical main body portion and opposite inner and outer end portions, said inner handle portion extending through said terminal opening in said outer end portion of said intermediate handle portion, said inner end portion of said inner handle portion being telescopically received in said central passage in said intermediate handle portion;

a brush for sweeping engagement with the golf green, said brush being secured on said outer end portion of said inner handle portion;

said inner handle portion being fully enclosed within said intermediate handle portion, and said intermediate handle portion being fully enclosed within said outer handle portion, when said brush assembly is in the retracted condition;

said outer end portion of said intermediate handle portion being radially outward of said outer end portion of said inner handle portion when said brush assembly is in the retracted condition;

said outer end portion of said intermediate handle portion, and said outer end portion of said inner handle portion, being spaced axially inward from said outer end portion of said outer handle portion by a distance approximately equal to the length of said brush when said brush assembly is in the retracted condition;

said brush being fully enclosed within said outer end portion of said outer handle portion but not being enclosed by said intermediate handle portion when said brush assembly is in the retracted condition.

7. A brush assembly as set forth in claim 6 wherein said outer end portion of said outer handle portion is tapered radially inward in a direction toward said central axis from said cylindrical main body portion;

said outer end portion of said intermediate handle portion is tapered radially inward in a direction toward said central axis from said cylindrical main body portion;

said inner end portion of said intermediate handle portion is tapered radially outward in a direction toward said central axis from said cylindrical main body portion;

said inner end portion of said outer handle portion is tapered radially outward in a direction toward said central axis from said cylindrical main body portion, and said outwardly tapered inner end portion of said outer handle portion interlocking with said inwardly tapered outer end portion of said intermediate handle portion when said brush assembly is in the extended condition, and said outwardly tapered inner end portion of said intermediate handle portion interlocking with said inwardly tapered outer end portion of said outer handle portion when said brush assembly is in the extended condition, to lock said brush assembly in the extended condition.

8. A brush assembly as set forth in claim 6 wherein said brush of said brush assembly has a plurality of outwardly biased tufts, and said brush assembly is held closed when in the retracted condition by the outwardly biased pressure of said tufts against said inwardly tapered outer end portion of said outer handle portion.

* * * * *